US006722939B2

(12) United States Patent
An

(10) Patent No.: US 6,722,939 B2
(45) Date of Patent: Apr. 20, 2004

(54) INTERMITTENT ACTUATOR OF MOVING BEAR TOY

(75) Inventor: Sang-Min An, Busan (KR)

(73) Assignee: Jamina Corporation, Busan (KR)

( * ) Notice: Subject to any disclaimer, the term of this patent is extended or adjusted under 35 U.S.C. 154(b) by 38 days.

(21) Appl. No.: 10/238,855

(22) Filed: Sep. 11, 2002

(65) Prior Publication Data

US 2003/0232570 A1 Dec. 18, 2003

(30) Foreign Application Priority Data

Jun. 15, 2002 (KR) ..... 2002-18210 U

(51) Int. Cl.[7] ..... A63H 11/00; A63H 13/00; A63H 3/20

(52) U.S. Cl. ..... 446/330; 446/352; 446/376

(58) Field of Search ..... 446/314, 315, 446/316, 330, 332–336, 352–356, 366, 367, 377–381, 390; 74/24

(56) References Cited

U.S. PATENT DOCUMENTS 3,731,545 A * 5/1973 Beezer ..... 74/24
4,245,515 A * 1/1981 Iwaya ..... 74/25
5,374,216 A * 12/1994 Jung et al. ..... 446/175
5,842,906 A * 12/1998 Terzian et al. ..... 446/330
6,165,043 A * 12/2000 Terzian et al. ..... 446/356
6,454,626 B1 * 9/2002 An ..... 446/330
6,478,652 B1 * 11/2002 Van der Linde ..... 446/355

* cited by examiner

*Primary Examiner*—Jacob K. Ackun
*Assistant Examiner*—Bena Miller
(74) *Attorney, Agent, or Firm*—Birch, Stewart, Kolasch & Birch, LLP

(57) ABSTRACT

An intermittent actuator of moving bear toy, which can continue a dancing motion of the moving bear toy, is disclosed. The intermittent actuator is to operate the existing moving bear toy capable of performing motions of walking, standing with roaring, and dancing with front legs. The intermittent actuator, which can continuously perform the above motions by operation of a stopper, a timing cam and a plate for an intermittent operation, can be manufactured at a low price and strengthen the price competitiveness.

1 Claim, 5 Drawing Sheets

INTERMITTENT ACTUATOR OF MOVING BEAR TOY

BACKGROUND OF THE INVENTION

1. Field of the Invention

The present invention relates to an intermittent actuator of moving bear toy, and more particularly, to an intermittent actuator of moving bear toy capable of continuing a dancing motion of a moving bear toy at a low price.

2. Background of the Related Art

Korean Utility Model Reg. No. 238521, invented by the same inventor as the present invention, discloses a bear toy actuator capable of performing various motions, i.e., a walking motion, a motion of standing with two feet, a motion of dancing to music and a motion of walking with roaring, thereby giving an impression of a live bear.

A method for continuing the dancing motion of the prior art is that a cam of an output terminal is stopped with operation of a one-directional clutch by changing a rotational direction of a motor by electronic control and the dancing motion is repeated by changing the rotational direction using an electronic program time setting and a sensor switch.

However, the prior art has several problems that because the operator for the dancing motion of the moving bear toy is very expensive, there are an obstacle in developing inexpensive products and a bad influence on selling the products.

SUMMARY OF THE INVENTION

Accordingly, the present invention is directed to an intermittent actuator capable of keeping a dancing motion of moving bear toy that substantially obviates one or more problems due to limitations and disadvantages of the related art.

An object of the present invention is to provide an intermittent actuator of moving bear toy capable of strengthening the price competitiveness by manufacturing the intermittent actuator of moving bear toy at a low price.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
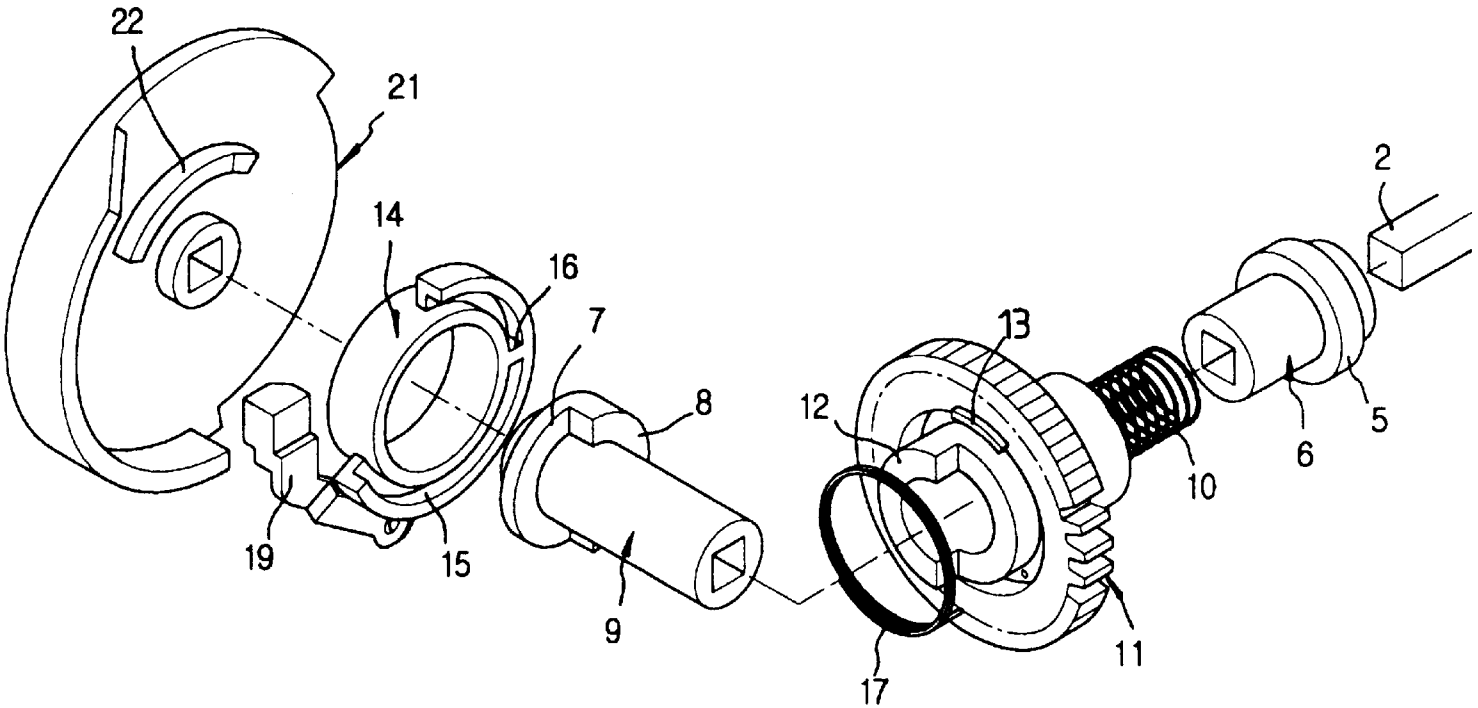
FIG. 1 is an exploded perspective view of a preferred embodiment of the present invention.
Figure 2:
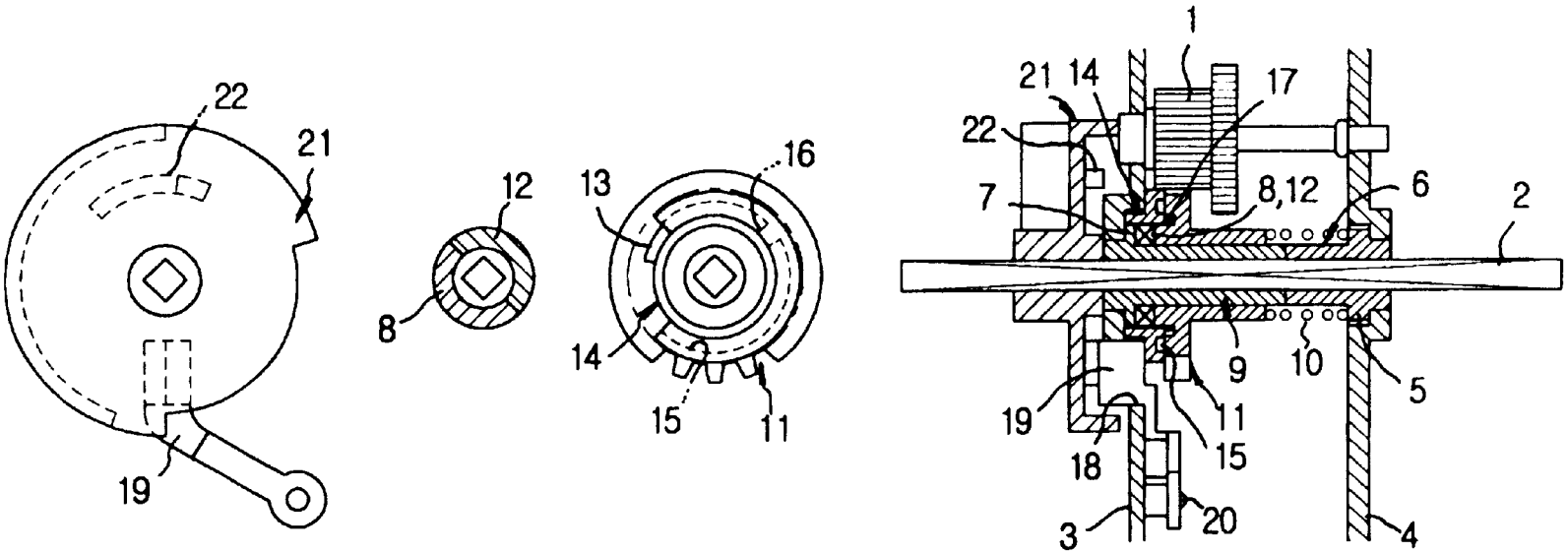
FIGS. 2 to 5 are sectional views of operation states of the present invention, and side views and sectional views of operation states of essential parts of the present invention.
Figure 3:
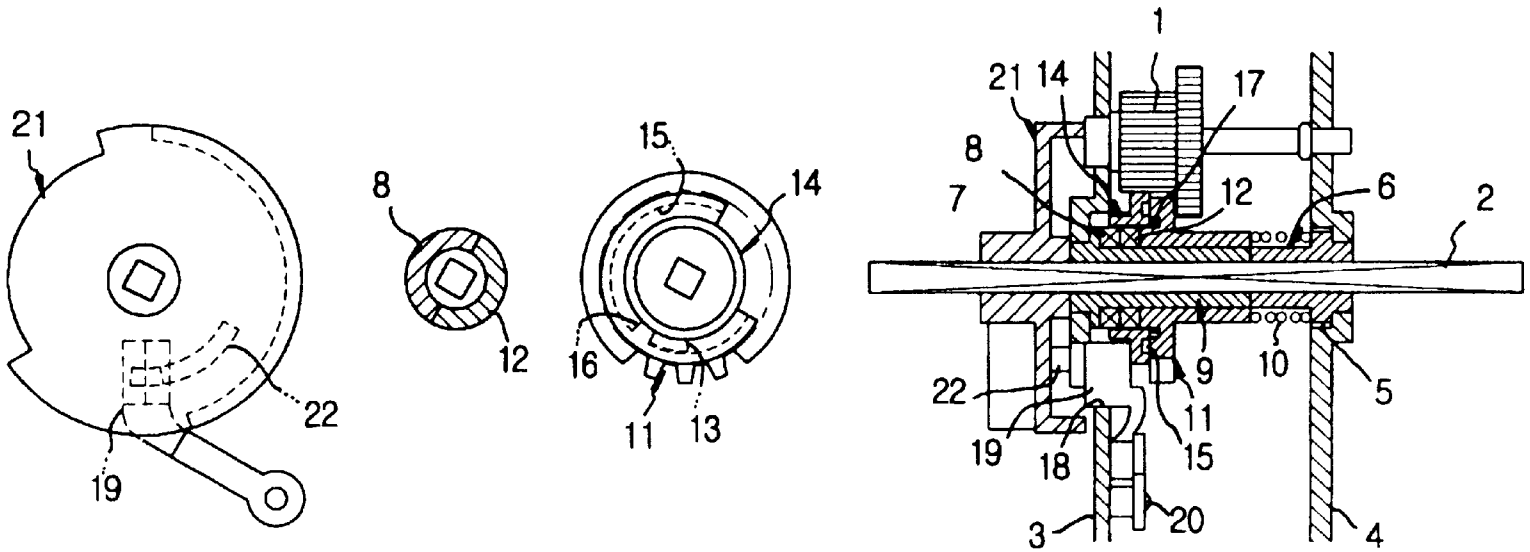
Figure 4:
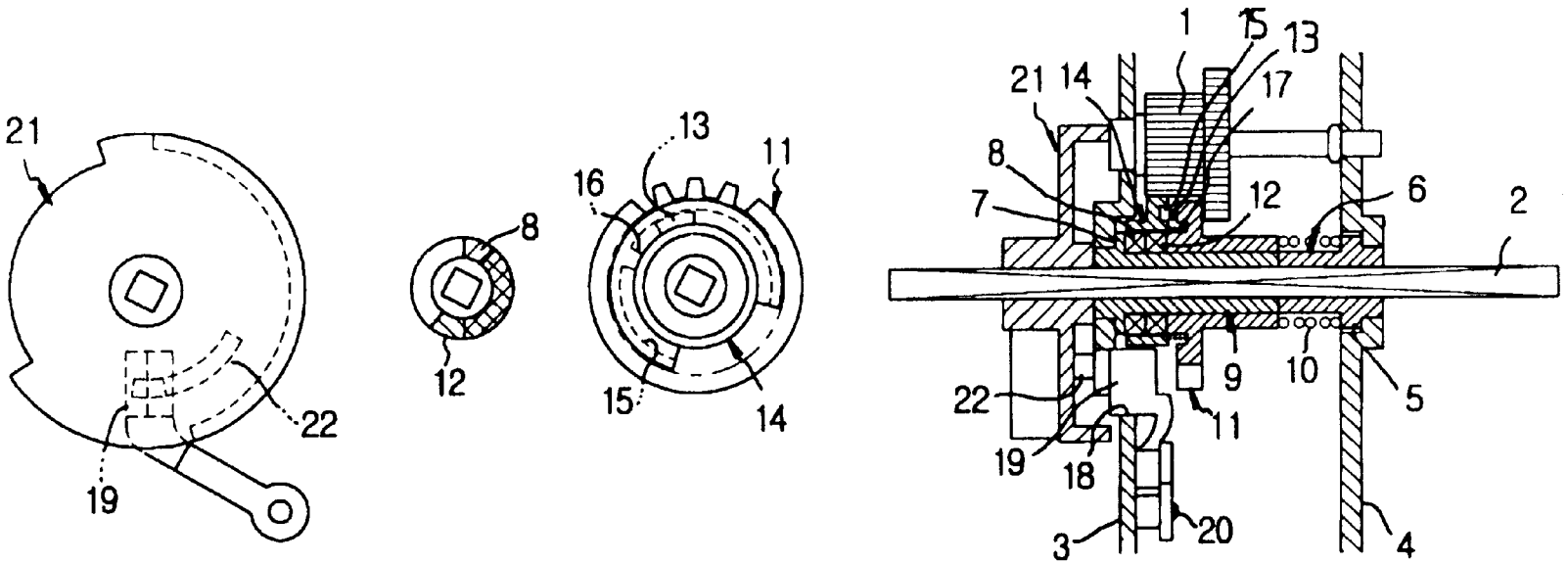
Figure 5:
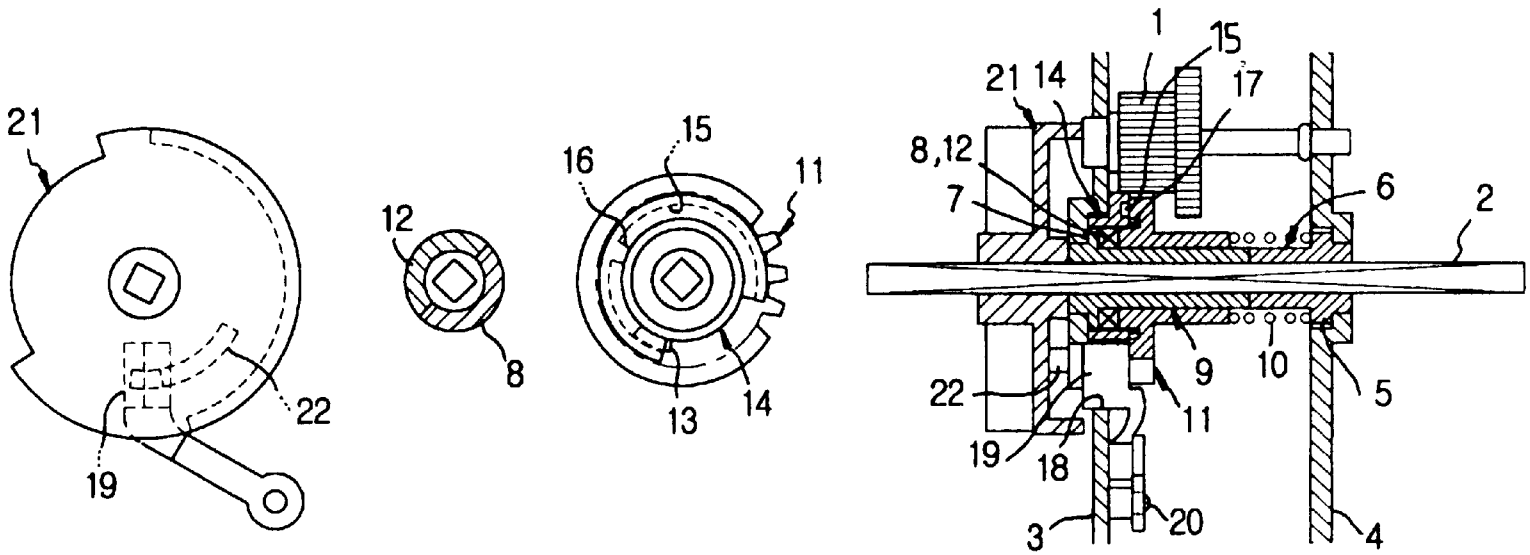

FIG. 1 is an exploded view of an intermittent operator of a moving bear toy according to the present invention, and FIGS. 2 to 5 are sectional views showing operation states of the present invention in order, and side views and sectional views of operation states of essential parts of the present invention. Referring to the drawings, the present invention will be described in detail as follows.

In the intermittent operator of a moving bear toy according to the present invention, a rectangular shaft 2 is mounted between upper portions of right and left frames 3 and 4. The rectangular shaft 2 is geared and rotated with a motor (not shown), which is an operation source of the moving bar toy, and a connection gear 1 of a reduction gear group. Separate spindles 6 and 9, which are separated into right and left sides, are fit on the rectangular shaft 2.

That is, the spindle 6, which has a flange 5 formed on the outer circumference, is on the right side of the rectangular shaft 2, and the spindle 9, which has a slave clutch 8 protruding semi-circularly, is fit on the left side of the rectangular shaft 2.

A clutch spring 10 is disposed on the outer circumference of the right side spindle 6 in such a manner that an end of the clutch spring 10 is contacted to the flange 5, and then, an output gear 11 is fit to the clutch spring 10.

The output gear includes a driving clutch 12 formed on the left side thereof and a protrusion 13 formed on a rectangular surface of the left side thereof. The protrusion 13 of the output gear 11 is guided to a hole 15 of a plate 14 fit on a flange 7 of the left side spindle 9, and then locked to a jaw 16 formed in the middle of the hole 15.

The output gear 11 and the plate 14 are elastically mounted by a spring 17 disposed between them.

Meanwhile, a hole 18 is formed in the left side frame 3, and a stopper 19, which has elasticity and is inserted into and removed from the hole 18, is mounted on the frame 3 with a fixing pin 20. A timing cam 21 contacted with the stopper 19 is fit on the rectangular shaft 2 protruding to the outside of the frame 3.

A projection cam 22 is formed on the inner surface (at the right side of the drawing) of the timing cam 21 and contacted with the stopper 19.

The intermittent operator of the moving bear toy according to the present invention can be applied to the moving bear toy (Korean Utility Model Reg. No. 238521), which has been invented by the same inventor as the present invention. The existing bear toy continuously repeats its motions by changing a rotational direction of the driving motor using an electronic program and a sensor switch, but the present invention repeats its motions by the operation of the stopper 19, the timing cam 21 and the plate 14 capable of an intermittent operation. Hereinafter, the operation of the present invention will be described in more detail.

The rotating power transmitted from the driving motor operates the output gear 11 through the connection gear 1 to operate the rectangular shaft 2 through the reduction gear group, and the rotating power of the output gear 11 controls output of the timing cam 21, which is the final output means.

That is, the rotating motion of the timing cam 21 controls the motions of front and rear legs of the moving bear toy through a number of rods and links interlocking with the timing cam 21.

The timing cam 21 provides special motions of the present invention with timing and stroke suitable for operating parts of the present invention. Referring to FIGS. 2 to 5, the special motions of the present invention will be described step by step.

First, in a first step (referring to FIG. 2), the moving bear toy performs others than a completely standing motion, such as walking motion or temporarily stop motion, when the output gear 11 and the timing cam 21 engage with each other. At this time, the plate 14 is operated and rotated together with the output gear 11, which has the protrusion 13 locked to the jaw 16 of the hole 15.

At this time, the clutch spring 10 is expanded, and the spring 17 of the plate 14 is contracted.

The output gear 11 and the timing cam 21 are connected with 180° half moon type engaging slave and driving clutches 12 and 8, and the timing cam 21, the spindles 6 and 9 and the rectangular shaft 2 are forcibly assembled, so that the timing cam 21 is rotated by receiving the rotational power transmitted from the connection gear 1.

In a second step (referring to FIG. 3), the protrusion cam 22 formed on the timing cam 21 reaches the stopper 19, and the inner surface of the stopper 19 pushes the left side of the plate 14 while the stopper 19 is pushed to the inside of the frame 3 through the hole 18. As the result, the output gear 11 connected with the plate 14 is also pushed, and then, the output gear 11 connected with the timing cam 21 through the slave and driving clutches 8 and 12 is interrupted in the rotational power from the timing cam 21.

The timing cam 21 is stopped in a condition that the slave and driving clutches 8 and 12 are separated. As the result, the interlocking of the timing cam 21 by the rotational friction of the output gear 11 is offset due to ground friction force of a rod and a link contacting and interlocking with the cam formed on the left side of the timing cam 21.

At this time, the plate 14 on the spindle 9 with the output gear 11 is rotated to a phase deviating from the stopper 19.

At this time, the clutch spring 10 is expanded, and the spring 17 of the plate 14 is contracted.

In a third step (referring to FIG. 4), the timing cam 21 is stopped, and the plate 14 interlocking and rotating with the protrusion 13 of the output gear 11 deviates from the stopper 19 and is separated from the protrusion 13 of the output gear 11 by restoring elasticity of the spring 17 elastically supporting the plate 14.

The output gear 11 is separated and rotated once in a state that the upper surfaces of the slave and driving clutches 8 and 12 operated integrally with the timing cam 21 are grounded with each other.

At this time, the clutch spring 10 is contracted, and the spring 17 of the plate 14 is expanded.

In a fourth step (referring to FIG. 5), when the rotation of the separated output gear 11 and timing cam 21 is finished, the plate 14 is deviated from the stopper 19 and separated from the output gear 11. At this time, the output gear 11 and the timing cam 21 are coupled with the slave and driving clutches 8 and 12.

Therefore, the timing cam 21 is rotated and the stopper 19, which is made of elastic material, is deviated from the protrusion cam 22, and thereby, the intermittent operator returns to the first step.

The plate 14 and the output gear 11 forcibly interlock with each other by the locking action of the protrusion 13 and the jaw 16 as rotating in a closely contact condition.

At this time, the clutch spring 10 is expanded, and the spring 17 of the plate 14 is contracted.

As described above, the present invention provides the intermittent actuator of the moving bear toy capable of continuing the dancing motion. The intermittent actuator of moving bear toy can strengthen the price competitiveness because being manufactured at a low price.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An intermittent actuator of moving bear toy capable of continuously performing motions of walking, standing with roaring, and dancing, the actuator comprising:

a rectangular shaft geared and rotated with a driving motor of the moving bear toy through a connection gear of a reduction gear group;

separate spindles fit on the rectangular shaft and mounted between upper portions of right and left frames, one of the spindles being fit on the right side of the rectangular shaft and having a flange formed on the outer circumference thereof, and the other being fit on the left side of the rectangular shaft and having a slave clutch semi-circularly protruding from another flange;

a clutch spring disposed on the outer circumference of the right side spindle in such a manner that an end thereof is in contact with the flange of the right side spindle;

an output gear fit on the clutch spring, the output gear engaging with the connection gear, the output gear having a driving clutch formed on the left side thereof and a protrusion formed on a rectangular surface of the left side thereof;

a plate having a hole and a jaw formed in the middle of the hole, the plate being fit on the flange of the left side spindle and elastically mounted by a spring, wherein the protrusion of the output gear is guided to the hole of the plate and locked to the jaw of the hole;

a stopper made of elastic material, the stopper being mounted on the left frame by a fixing pin, the stopper being capable of being inserted into and removed from a hole formed in the left frame;

a timing cam fit on the rectangular shaft protruding to the outside of the left frame, the timing cam being contacted with the stopper; and a protrusion cam formed on the inner surface of the timing cam, the protrusion cam being contacted with the stopper.

* * * * *